US008519642B2

(12) United States Patent
Ahn et al.

(10) Patent No.: US 8,519,642 B2
(45) Date of Patent: Aug. 27, 2013

(54) LED LIGHT EMITTING DEVICE

(75) Inventors: Byunghak Ahn, Seoul (KR); Hak-Hee Lee, Gyonggi-do (KR); Il-Young Jung, Gyonggi (KR); Eung-Woo Lee, Seoul (KR)

(73) Assignee: Fairchild Korea Semiconductor Ltd., Bucheon (KR)

( * ) Notice: Subject to any disclaimer, the term of this patent is extended or adjusted under 35 U.S.C. 154(b) by 260 days.

(21) Appl. No.: 12/850,996

(22) Filed: Aug. 5, 2010

(65) Prior Publication Data

US 2011/0037407 A1 Feb. 17, 2011

(30) Foreign Application Priority Data

Aug. 14, 2009 (KR) ..... 10-2009-0075434

(51) Int. Cl.
*H05B 37/00* (2006.01)

(52) U.S. Cl.
USPC ..... 315/312; 315/209 R; 315/291

(58) Field of Classification Search
USPC ..... 315/209 R, 210, 224, 287, 291, 294, 315/297, 302, 307, 312
See application file for complete search history.

(56) References Cited

U.S. PATENT DOCUMENTS 6,690,591 B2 2/2004 Min
7,244,036 B2 * 7/2007 Murakami et al. ..... 362/20
7,256,554 B2 * 8/2007 Lys ..... 315/291
7,262,559 B2 8/2007 Tripathi et al.
7,327,051 B2 * 2/2008 Ito et al. ..... 307/10.8
7,482,765 B2 * 1/2009 Ito et al. ..... 315/312
7,518,319 B2 4/2009 Konno et al.
7,855,520 B2 * 12/2010 Leng ..... 315/307
7,880,401 B2 * 2/2011 Kitagawa et al. ..... 315/247
7,964,988 B2 * 6/2011 Kitagawa et al. ..... 307/10.8
8,259,097 B2 * 9/2012 Kim et al. ..... 345/212
2006/0082332 A1 * 4/2006 Ito et al. ..... 315/291
2006/0238466 A1 10/2006 Chen et al.
2008/0061716 A1 3/2008 Kim et al.
2008/0150877 A1 6/2008 Chao et al.
2008/0309244 A1 12/2008 Hsu
2009/0009088 A1 * 1/2009 Ito et al. ..... 315/77
2010/0019696 A1 * 1/2010 Kimura ..... 315/297
2011/0148319 A1 * 6/2011 Terazawa ..... 315/291

FOREIGN PATENT DOCUMENTS

EP 2 001 132 A1 10/2008

* cited by examiner

*Primary Examiner* — Jason M Crawford
(74) *Attorney, Agent, or Firm* — Okamoto & Benedicto LLP

(57) ABSTRACT

An LED light emitting device includes LED channels with LEDs, a transformer that converts an input voltage and supply an output voltage to the LED channels, a controller, and an LED driver. The controller controls the transformer according to a first feedback signal for interrupting power supply to the LED channels when a dimming off state in which currents are not supplied to the plurality of LED channels occurs or when a state in which the maximum channel voltage of a plurality of channel voltages corresponding to voltages applied to the LED channels, respectively, is an overvoltage and a defective state in which the plurality of LED channels include an open state are maintained during a predetermined threshold period. The LED driver generates information on the dimming off state and information on the defective state.

22 Claims, 4 Drawing Sheets

LED LIGHT EMITTING DEVICE

CROSS-REFERENCE TO RELATED APPLICATION

This application claims priority to and the benefit of Korean Patent Application No. 10-2009-0075434 filed in the Korean Intellectual Property Office on Aug. 14, 2009, the entire contents of which are incorporated herein by reference.

BACKGROUND OF THE INVENTION (a) Field of the Invention

The present invention relates to an LED light emitting device and a driving method thereof, and more particularly, to an LED light emitting device including a plurality of LED channels each of which a plurality of LEDs are connected in series.

(b) Description of the Related Art

A light emitting device using LEDs supplies currents to the LEDs so as to drive the LEDs. Then, the LEDs emit beams having brightness corresponding to the currents. Such an LED light emitting device can be used as a light source of an LCD or a lighting. A light emitting device that uses LEDs and is used as a light source of an LCD or a lighting is referred to as an LED light emitting device. An LED light emitting device provides a predetermined intensity by making a predetermined current flow in each LED channel including a plurality of LEDs connected in series. An LED light emitting device according to the related art includes a plurality of converters for supplying a current to each of a plurality of LED channels. Specifically, when an LED light emitting device includes a plurality of LED channels and the plurality of LED channels are connected in parallel, a plurality of converters for supplying currents to the individual LED channels are necessary. This type of LED light emitting device needs a large space for including the plurality of converters and the manufacturing cost of the LED light emitting device increases.

Unlike this, another type in which one power supply device supplies currents to a plurality of LED channels exists. This type cannot ensure supply of a constant current to the individual LED channels. Because of a deviation in the characteristics of LED elements, supply of the same voltage to the LED channels may not generate the same current. In order to solve this, a plurality of current control units for constantly linearly controlling current flowing in a plurality of LED channels are connected. This addition of the plurality of current control units causes power consumption.

FIG. 1 is a drawing schematically illustrating a configuration of an LED light emitting device according to the related art.

As shown in FIG. 1, an LED light emitting device includes a power supply device 1, an LED panel 2, and an LED driver 3.

The power supply device 1 includes a transformer 21, a gate driver 22, a power switch S, and a smoothing capacitor C1. The transformer 21 converts an input voltage Vin to an output voltage Vout, and supplies the output voltage to the LED panel 2. At this time, the operation of the transformer 21 is controlled by a switching operation of the power switch S. The controller 22 controls the switching operation of the power switch S according to the output voltage Vout and feedback information fb transmitted from the LED driver 3.

The LED panel 2 includes a plurality of LED channels same as an LED channel 21 in which a plurality of LEDs are connected in series.

The LED driver 3 includes a plurality of current control units (not shown) and constantly controls a current flowing in each of the plurality of LED channels. The LED driver 3 transmits information on currents of the plurality of LED channels and voltages applied to the LED channels as the feedback information fb to the power supply device 1.

The controller 22 controls the switching operation of the power switch according to the feedback information and the transformer generates the output voltage for driving the LED panel 2 according to the operation of the power switch.

However, a period in which a current is not supplied to the LED panel may occur during the operation of the LED light emitting device. During that period, an over-shoot phenomenon in which the output voltage rises occurs. Further, if a current necessary for the LED panel rapidly increases, a phenomenon in which the output voltage falls occurs. For example, when a current is supplied to the plurality of LED channels of the LED panel in an OFF state, a current necessary for the LED panel rapidly increases.

Further, when an LED of the LED channels is short-circuited or opened so as not to perform an appropriate function (hereinafter, a defective state), it is necessary to interrupt the switching operation of the power switch S. In the defective state, a channel voltage that is the end terminal voltage of the LED channel becomes an over voltage or an LED current does not flow. Further, when an LED is short-circuited, the LED driver 3 may be damaged by an overcurrent flowing in the LED channel, and when an LED is opened, a phenomenon in which the output voltage rises very highly may occur.

The controller 22 determines the state of the LED panel described in the above two paragraphs from the feedback information fb. If the primary side and secondary side of the transformer 21 are insulated, it is difficult for the controller 22 to exactly receive the feedback information. Then, it is difficult for the controller 22 to exactly control the operation of the power supply device 1. That is, the power supply device 1 may not supply power according to the state of the LED panel 2 or may supply an overvoltage to increase the power consumption. Heat generated in the LED driver may increase to damage the LEDs or the LED driver.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide an LED light emitting device having advantages of exactly transmitting a state of an LED panel.

An exemplary embodiment of the present invention provides an LED light emitting device including plurality of LED channels including a plurality of LEDs that includes a transformer, a controller, and an LED driver. The transformer converts an input voltage and supplies an output voltage to the plurality of LED channels. The controller controls the transformer according to a first feedback signal for interrupting power supply to the plurality of LED channels when a dimming off state in which currents are not supplied to the plurality of LED channels occurs or when a state in which the maximum channel voltage of a plurality of channel voltages corresponding to voltages applied to the plurality of LED channels, respectively, is an overvoltage and a defective state in which the plurality of LED channels include an open state are maintained during a predetermined threshold period. The LED driver generates information on the dimming off state and information on the defective state. The LED driver is connected to a secondary side of the transformer, the controller is connected to a primary side of the transformer insulated from the secondary side, and the first feedback signal is generated according to the information on the dimming off state and the information on the defective state. The LED driver includes a first feedback signal controller including a first sink current source for supplying a first sink current when the dimming off state occurs, and a second sink current source for supplying a second sink current when the defective state occurs, and a first feedback signal generator including a first photo diode emitting beams corresponding to the first sink current and the second sink current, and a first photo transistor in which a current corresponding to an amount of beam emitted by the first photo diode flows.

The LED driver further includes a defect sensor configured to receive a first current when at least one of the plurality of LED channels is in an open state, to receive a second current when the maximum channel voltage is an overvoltage, and to control the first feedback signal controller such that the second sink current flows in the first feedback signal generator when a voltage charged by the first current and the second current is equal to or greater than a defect voltage for determining the defective state. The defect sensor includes a capacitor, a first switch connected between the capacitor and a first current source for supplying the first current, a second switch connected between the capacitor and a second current source for supplying the second current, and a comparator configured to receive a voltage charged in the capacitor and the defect voltage and to compare them. An output voltage of the comparator is transferred to the first feedback signal controller.

Further, the LED driver further includes a dimming-off determining unit configured to determine the dimming off state by using a plurality of dimming signals controlling current supply to the plurality of LED channels, and the dimming-off determining unit controls the first feedback signal controller such that the first sink current flows in the first feedback signal generator. The first feedback signal controller includes a first switch connecting the first sink current source and the first feedback signal generator, and a second switch connecting the second sink current source and the second feedback signal generator, and the second sink current is larger than the first sink current.

The controller controls the operation of the transformer according to a second feedback signal based on a minimum channel voltage of the plurality of channel voltages, and maintains the second feedback signal corresponding to a start time point of the dimming off state. The LED light emitting device further includes a second feedback signal generator configured to generate the second feedback signal to correspond to a comparison voltage corresponding to the minimum voltage, and to constantly maintain the second feedback signal corresponding to the start time point of the dimming off state. The LED driver further includes a second feedback signal controller configured to control the second feedback signal generator such that the minimum channel voltage is maintained at a minimum reference voltage.

The second feedback signal controller includes a shunt regulator including a first terminal to receive the minimum channel voltage, a second terminal grounded, and a third terminal connected to the second feedback signal generator, and configured to interrupt the second terminal and the third terminal when the minimum channel voltage is smaller than the minimum reference voltage and to connect the second terminal and the third terminal when the minimum channel voltage is equal to or greater than the minimum reference voltage, and a capacitor connected between the third terminal and the first terminal. The comparison voltage is a voltage of the third terminal. The second feedback signal generator includes a second photo diode having a cathode electrode connected to the third terminal and an anode to which a predetermined current is supplied, a second feedback signal generator including a second photo transistor in which a current corresponding to an amount of beam emitted by the second photo diode flows, and a switch configured to be turned off during the dimming off period so as to interrupt current supply to the second photo diode.

The controller includes a power switch connected to the primary side of the transformer, and a protection controller including a current mirror circuit for coping a current flowing in the first photo transistor and supplying currents to a first resistor and a second resistor, and the power switch is turned off according to a dimming off signal generated by supplying the current to the first resistor and a protection signal generated by supplying the current to the second resistor. The controller further includes an SR latch configured to receive the protection signal through a set terminal and generate and maintain a signal for turning off the power switch at a time point when the protection signal changes form a first level to a second level, and a gate driver configured to generate a gate signal for controlling the switching operation of the power switch according to an output signal of the SR latch and the dimming off signal.

The controller further includes a PWM controller configured to control the operation of the power switch according to a second feedback signal based on the minimum channel voltage of the plurality of channel voltages and to maintain the second feedback signal corresponding to a start time point of the dimming off state during the dimming off state period. The LED light emitting device further includes a second feedback signal generator configured to generate a second feedback signal to correspond to a comparison voltage corresponding to the minimum channel voltage, and to constantly maintain the second feedback signal corresponding to the start time point of the dimming off state during the dimming off state. The LED driver further includes a second feedback signal controller configured to control the second feedback signal generator such that the minimum channel voltage is maintained at a predetermined minimum reference voltage.

The first resistor has a resistance value smaller than the second resistor.

According to an embodiment of the present invention, an LED light emitting device that exactly transmits a state of a LED panel is provided.

DETAILED DESCRIPTION OF THE EMBODIMENTS

Figure 1:
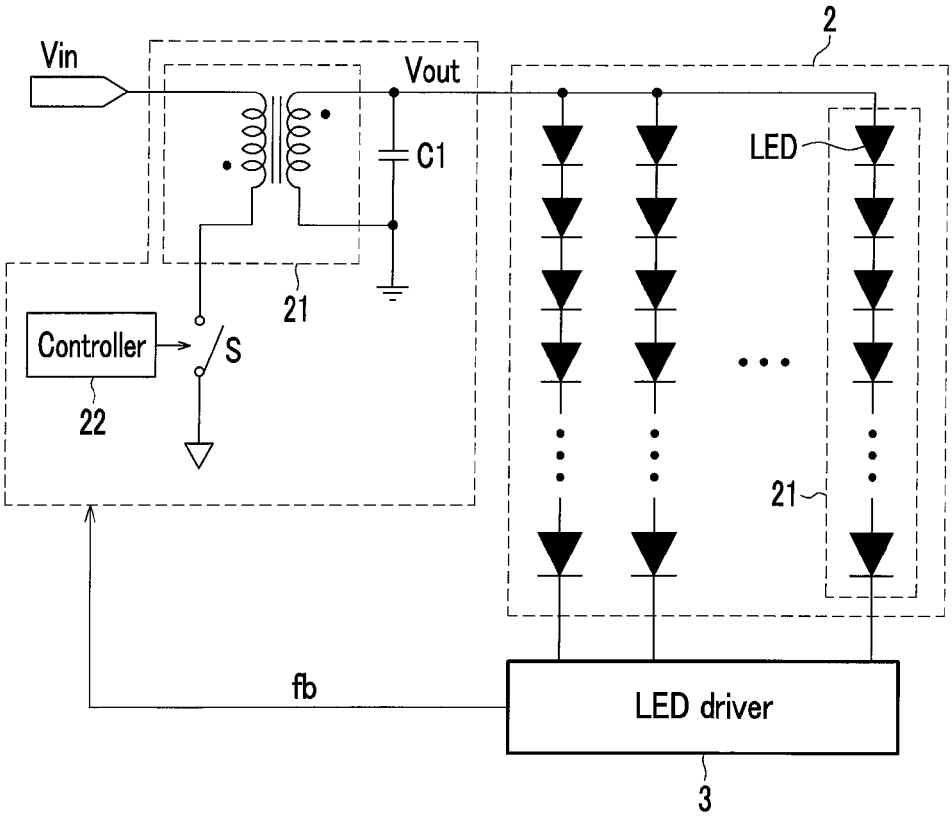
FIG. 1 (Prior Art)
FIG. 1 is a drawing schematically illustrating a configuration of an LED light emitting device according to the related art.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

In specification and the claims that follow, when it is described that an element is "coupled" to another element, the element may be "directly coupled" to the other element or "electrically coupled" to the other element through a third element. In addition, unless explicitly described to the contrary, the word "comprise" and variations such as "comprises" or "comprising", will be understood to imply the inclusion of stated elements but not the exclusion of any other elements.

Hereinafter, an LED light emitting device according to an exemplary embodiment of the present invention will be described in detail with reference to the accompanying drawings.

Figure 2:
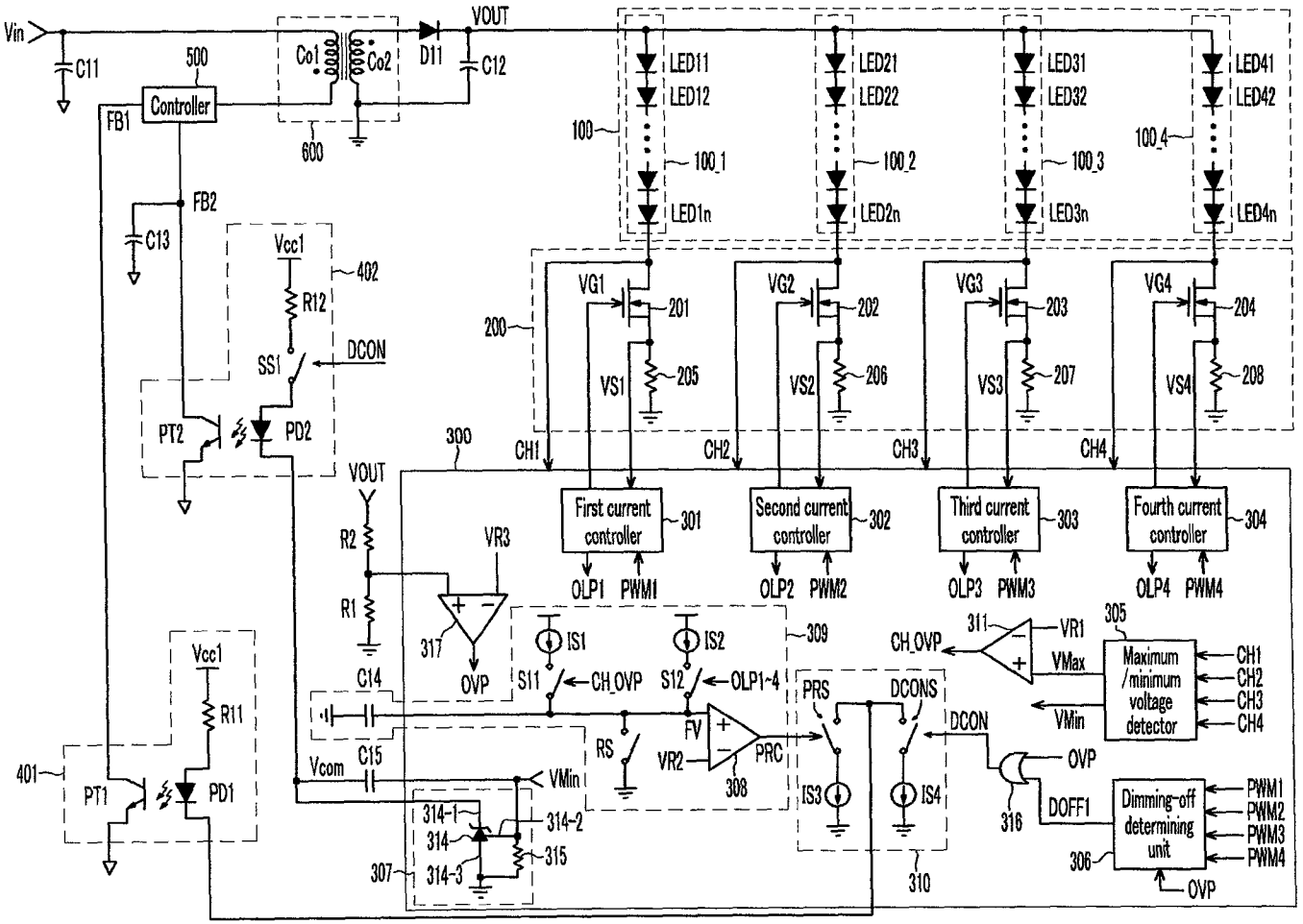
FIG. 2 is a drawing illustrating an LED light emitting device according to an exemplary embodiment of the present invention.

FIG. 2 is a drawing illustrating an LED light emitting device according to an exemplary embodiment of the present invention.

As shown in FIG. 2, an LED light emitting device includes an LED panel unit 100, a current source 200, an LED driver 300, a first feedback signal generator 401, a second feedback signal generator 402, a controller 500, and a transformer 600.

The LED panel unit 100 includes a plurality of LED channels 100-1 to 100-4 and each of the plurality of LED channels 100-1 to 100-4 includes n LEDs connected in series. Specifically, the LED channel 100-1 includes n LEDs LED11 to LED1*n*, and the n LEDs LED11 to LED1*n* are connected in series. Similarly, a plurality of LED channels 100-2 to 100-4 include n LEDs LED21 to LED2*n*, LED31 to LED3*n*, and LED41 to LED4*n*, respectively. In the exemplary embodiment of the present invention, a case in the number of the plurality of LED channels 100-1 to 100-4 is four is described. However, the present invention is not limited thereto. This is just an example.

In the transformer 600, a primary-side coil CO1 and a secondary-side coil CO2 are insulated and coupled with a predetermined turn ratio. A diode D11 for performing rectification such that a current flowing in the secondary-side coil CO2 flows into the LED panel unit 100 is connected to one end of the secondary-side coil CO2. A capacitor C12 is charged with current supplied through the diode D11 to generate an output voltage VOUT. If the current supplied to the LED panel unit 100 increases (a load increases), a current from the capacitor C12 is supplied to the LED panel unit 100 such that the output voltage VOUT decreases. In contrast, the current supplied to the LED panel unit 100 decreases (the load decreases), a current flows in the capacitor C12 such that the output voltage VOUT increases. The controller 500 receives a first feedback signal FB1 and a second feedback signal FB2 from first and second feedback signal generators 401 and 402 and controls the switching operation of a power switch M (see FIG. 4). Then, the controller 500 controls the minimum channel voltage VMin to be constantly maintained by using the second feedback signal FB2.

The current source 200 is connected to ends of the plurality of LED channels 100-1 to 100-4 and sinks a constant current from the LED panel unit 100. The current source 200 includes a plurality of transistors 201 to 204 connected to the plurality of LED channels 100-1 to 100-4, and a plurality of resistors 205 to 208 each of which has one end connected to a corresponding one of the plurality of transistors 201 to 204 and the other end grounded. The plurality of transistors 201 to 204 are rendered conductive according to gate signals VG1 to VG4 transmitted from the LED driver 300, and currents flowing in the plurality of transistors 201 to 204 are channel currents ILED1 to ILED4 flowing in the plurality of LED channels 100-1 to 100-4. The channel currents ILED1 to ILED4 flows in the plurality of resistors 205 to 208, respectively, such that a plurality of feedback voltages VS1 to VS4 are transferred to the LED driver 300. Voltages on ends to which the transistors 201 to 204 corresponding to the plurality of LED channels 100-1 to 100-4, respectively, are connected are a plurality of channel voltages CH1 to CH4 representing voltages of the plurality of LED channels 100-1 to 100-4. The plurality of channel voltages CH1 to CH4 are transferred to the LED driver 300. According to an exemplary embodiment of the present invention, N-channel-type MOSFETs (metal oxide semiconductor field effect transistor) are used as the transistors. However, the present invention is not limited thereto.

Figure 4:
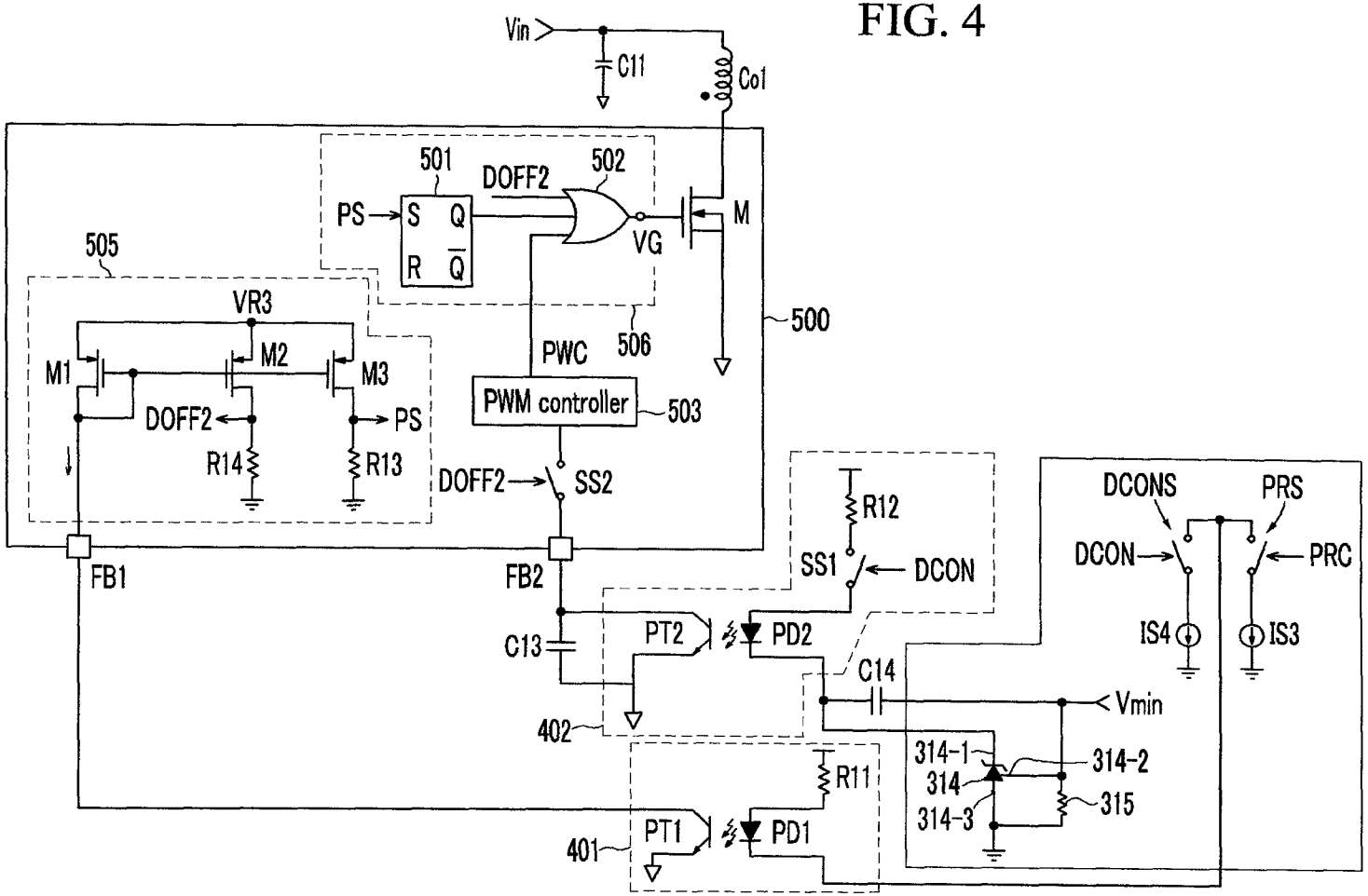
FIG. 4 is a drawing illustrating a configuration of the controller 500 according to an exemplary embodiment of the present invention.

The LED driver 300 receives the plurality of feedback voltages VS1 to VS4 and the plurality of channel voltages CH1 to CH4, turns on the transistors 201 to 204, and generates feedback information for controlling the switching operation of the power switch M (see FIG. 4). The LED driver 300 according to an exemplary embodiment of the present invention generates the first feedback signal FB1 and the second feedback signal FB2 as the feedback information. The LED driver 300 includes a plurality of first to fourth current controllers 301 to 304 for controlling the currents of the plurality of LED channels 100-1 to 100-4, respectively, a maximum/minimum voltage detector 305, a dimming-off determining unit 306, a first feedback signal controller 310, a protection comparator 317, a defect sensor 309, and a second feedback signal controller 307.

Figure 3:
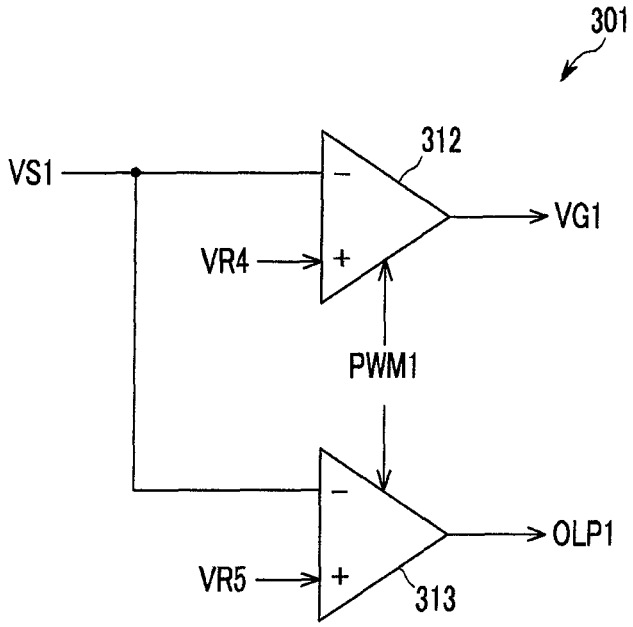
FIG. 3 is a drawing illustrating the first current controller 301 according to an exemplary embodiment of the present invention.

FIG. 3 is a drawing illustrating the first current controller 301 according to an exemplary embodiment of the present invention. The other second to fourth current controllers 302 to 304 have the same configuration as the first current controller 301. Hereinafter, the first current controller 301 is described in detail with reference to FIG. 3, and a description of the second to fourth current controllers 302 to 304 is omitted.

The first current controller 301 receives the feedback voltage VS1, controls a conduction level of the transistor 201 such that the channel current ILED1 is constantly maintained, and generates a protection control signal OLP1 representing an LED, being in an open state, of the LEDs of the LED channel 100-1. The first current controller 301 includes an error amplifier 312 and an open-state determination comparator 313.

The error amplifier 312 amplifies a difference between the feedback voltage VS1 and a constant current reference voltage VR4 to generate a gate signal VG1. The error amplifier 312 is enabled by a first dimming signal PWM1 determining a light emission period of the LED channel 100-1. The error amplifier 312 according to an exemplary embodiment of the present invention is enabled by the first dimming signal PWM1 at a high level. When the error amplifier 312 is in a disable state, the transistor 201 is in an OFF state such that the channel current ILED1 does not flow. Further, since the transistor 201 is an N type, as the gate signal VG1 increases, the conductance increases.

When the first feedback voltage VS1 becomes small than the constant current reference voltage VR4, the error amplifier 312 amplifies an error of two voltages to generates the gate signal VG1. The conductance of the transistor 201 increases by the gate signal VG1 and thus the channel current ILED1 also increases. In contrast, when the first feedback voltage VS1 becomes large than the constant current reference voltage VR4, the error amplifier 312 reduces the gate signal VG1. Then, the conductance of the transistor 201 decreases by the gate signal VG1 and thus the channel current ILED1 decreases. As such, the first current controller 301 detects the channel current ILED1 by using the first feedback voltage VS1 and constantly maintains the channel current ILED1.

The open-state determination comparator 313 determines whether the LED channel is in an open state by using the feedback voltage. When at least one of the plurality of LEDs of the LED channel 100-1 is opened, the channel current ILED1 does not flow in the LED channel 100-1. At this time, the voltage between both ends of the transistor 201 increases and the feedback voltage VS1 decreases. When the first feedback voltage VS1 becomes low than a predetermined open-state reference voltage VR5, the open-state determination comparator 313 generates an open-state signal OLP1 at a high level. The level of the open-state reference voltage VR5 may be set a voltage which is larger by a predetermined margin than the plurality of first to fourth feedback voltages VS1 to VS4 generated when the LED channels are in the open state. The margin may be set considering a ripple of the feedback voltages.

The open-state determination comparator 313 includes an inversion terminal '−' to which the first feedback voltage VS1 is input and a non-inversion terminal '+' to which the open-state reference voltage VR5 is input. Therefore, when an LED of the LED channel 100-1 is opened such that the LED channel 100-1 is opened, the open-state determination comparator 313 generates the open channel signal OLP1 at the high level. The open-state determination comparator 313 is enabled by the first dimming signal PWM1 at the high level and is disabled by the first dimming signal PWM1 at the low level so as not to operate.

The maximum/minimum voltage detector 305 determines and outputs the minimum channel voltage VMin and the maximum channel voltage VMax of the plurality of channel voltages CH1 to CH4.

A channel overvoltage comparator 311 determines whether the maximum channel voltage VMax is an overvoltage. Specifically, if the maximum channel voltage VMax is larger than a predetermined overvoltage reference voltage VR1, the channel overvoltage comparator 311 generates a channel overvoltage signal CH_OVP at a high level. If not, the channel overvoltage comparator 311 generates the channel overvoltage signal at a low level.

The dimming-off determining unit 306 determines a dimming off period in which all of the plurality of LED channels 100-1 to 100-4 do not emit light. Specifically, the dimming-off determining unit 306 may determines the dimming off period by using all of first to fourth dimming signals PWM1 and PWM4 controlling the light emitting time of the plurality of LED channels 100-1 to 100-4. In an exemplary embodiment of the present invention, since the plurality of LED channels 100_1 to 100_4 emit light according to the first to fourth dimming signals PWM1 to PWM4 at the high level, the dimming-off determining unit 306 determines a period in which the first to fourth dimming signals PWM1 to PWM4 at the low level are input as the dimming off period. The dimming-off determining unit 306 generates a dimming off signal DOFF1 during the dimming off period.

The protection comparator 317 generates an overvoltage protection signal OVP when the output voltage VOUT rises and becomes an overvoltage. The protection comparator 317 compares a voltage obtained by dividing the output voltage VOUT by resistors with a predetermined reference voltage VR3, and generates the overvoltage protection signal OVP when the output voltage VOUT is equal to or greater than the reference voltage VR3. In an exemplary embodiment of the present invention, since the voltage obtained by dividing the output voltage VOUT by the resistors is input to a non-inversion terminal '+' of the protection comparator 317 and the reference voltage VR3 is input to an inversion terminal '−', the overvoltage protection signal OVP has a high level.

The second feedback signal controller 307 controls a second feedback signal generator 402 such that the minimum channel voltage VMin is maintained at a predetermined minimum reference voltage. The second feedback signal controller 307 includes a shunt regulator 314, and the shunt regulator 314 includes three terminals 314-1, 314-2, and 314-3. The minimum channel voltage VMin is transferred to one end of a resistor 315 and the one end of the resistor 315 is connected to the terminal 314-2 of the shunt regulator 314. The other end of the resistor 315 is grounded. The terminal 314-1 is connected to the second feedback signal generator 402, the minimum channel voltage VMin is input to the terminal 314-2, and the terminal 314-3 is grounded.

The shunt regulator 314 compares the minimum channel voltage VMin with a reference voltage. When the minimum channel voltage VMin is lower than the reference voltage, a portion between the terminal 314-1 and the terminal 314-3 is opened such that a current does not flow through the shunt regulator 314. When a feedback switch SS2 (FIG. 4) is on-state and the current does not flow through the shunt regulator 314, the second feedback signal FB2 is increased.

When the minimum channel voltage VMin is equal to or greater than the reference voltage, a portion between the terminal 314-1 and the terminal 314-3 becomes conductive such that a current flows through the shunt regulator 314. Depending on how much greater the minimum channel voltage VMin is than the reference voltage, the more current flows through the shunt regulator 314. Thus, a current flowing through the second photo diode PD2 is increased, and a current flowing through the second photo transistor PT2 is increased. Further, the second feedback signal FB2 is decreased. The feedback signal FB2 is changed according to a variation of the minimum channel voltage VMin, and the minimum channel voltage VMin is maintained at the predetermined minimum reference voltage.

An output voltage of the shunt regulator 314 is the voltage of the terminal 314-1 and is referred to as a comparison voltage VCOM. One end of a capacitor C15 is connected to the terminal 314-1 of the shunt regulator 314, and the minimum channel voltage VMin is transferred to the other end. Oscillation of the comparison voltage VCOM according to a variation in the minimum channel voltage VMin is prevented.

The defect sensor 309 turns off the power switch M when a period in which the channel voltage is in an overvoltage state or the LED channel is in an open state (hereinafter, referred to as a defective period) is maintained during a predetermined defect threshold period. The defect threshold period is a factor capable of design change and means a maximum detective period that does not damage to the LED light emitting device. When the LED channel includes a short-circuited LED, the channel voltage may become an overvoltage. The defect sensor 309 senses a period in which the channel voltage is in an overvoltage state or the LED channel is in an open state by using the channel overvoltage signal CH_OVP and a plurality of open channel signals OLP1 to OLP4. Specifically, the defect sensor 309 includes a first current source IS1, a second current source IS2, a first switch S11, a second switch S12, a defect comparator 308, a reset switch RS, and a capacitor C14.

The first switch S11 performs a switching operation by the channel overvoltage signal CH_OVP, and the second switch S12 performs a switching operation by the open channel signals OLP1 to OLP4. Specifically, when the channel overvoltage signal CH_OVP has a high level for informing a channel overvoltage state, the first switch S11 is turned on, and when the channel overvoltage signal CH_OVP has a low level for informing the channel voltage is not in the channel overvoltage state, the first switch S11 is turned off. The second switch S12 is turned on when any one of the open channel signals OLP1 to OLP4 has a high level for informing an open channel state, and is turned off when all of the open cannel signals OLP1 to OLP4 have a low level for informing that the LED channels are not in the open channel state.

When any one of the first switch S11 and the second switch S12 is turned on, the capacitor C14 is changed by the first current source IS1 and the second current source IS2 and a defect voltage FV increases. Since a state in which the channel voltage is in an overvoltage state is relatively more dangerous than a state in which an open channel occurs, the magnitude of the current of the first current source IS1 is greater than the magnitude of the current of the second current source IS2. When the LED light emitting device starts an operation again after the switching operation of the power switch M is turned off, the reset switch RS is turned on to reset the defect voltage FV.

When the defect voltage FV reaches the defect reference voltage VR2, the defect comparator 308 generates a protection control signal PRC for turning off the power switch M. The defect reference voltage VR2 may be set to an appropriate value according to the defect threshold period. The defect comparator 308 includes a non-inversion terminal '+' to which the defect voltage FV is input, and an inversion terminal '−' to which the defect reference voltage VR2 is input. Therefore, when the defect period reaches the defect threshold period, the defect comparator 308 generates the protection control signal PRC at a high level. In a normal state, the protection control signal PRC has a low level.

An OR gate 316 performs a logical sum operation on the overvoltage protections signal OVP and a dimming off signal DOFF1 to generate a dimming off control signal DCON.

The first feedback signal controller 310 controls the first feedback signal generator 401 according to each of the protection control signal PRC and the dimming off control signal DCON. The first feedback signal controller 310 includes a first sink current source IS3, a second sink current source IS4, a protection switch PRS performing a switching operation by the protection control signal PRC, and a dimming off control switch DCONS performing a switching operation by the dimming off control signal DCON. When the protection control signal PRC has the high level, the protection switch PRS is turned on, and when the protection control signal PRC has the low level, the protection switch PRS is turned off. When the dimming off control signal DCON has the high level, the dimming off control switch DCONS is turned on, when the dimming off control signal DCON has the low level, the dimming off control switch DCONS is turned off. The current of the first sink current source IS3 is set to be larger than the current of the second sink current source IS4. Signals having different magnitudes may be transmitted to the first feedback signal generator 401 by using the first sink current source IS3 and the second sink current source IS4. That is, a signal transmitted to the first feedback signal generator 401 in a defective state is different from a signal transmitted to the first feedback signal generator 401 in a dimming off state.

The second feedback signal generator 402 generates the second feedback signal FB2 according to the comparison voltage VCOM supplied from the second feedback signal controller 307. The second feedback signal generator 402 includes a second photo transistor PT2 and a second photo diode PD2 forming a photo coupler, a resistor R12, and a feedback switch SS1. When a current flows in the second photo diode PD2 forming the photo coupler, a beam corresponding to the current is emitted, and the second photo transistor PT2 is driven such that a current according to the light emission level of the second photo diode PD2 flows. Therefore, the current proportional to the current flowing the second photo diode PD2 flows in the second photo transistor PT2.

A power voltage VCC1 is supplied to one end of the resistor R12, and one end of the feedback switch SS1 is connected to the other end of the resistor R12. An anode electrode of the second photo diode PD2 is connected to the other end of the feedback switch SS1, and the comparison voltage VCOM is transferred to a cathode electrode of the second photo diode PD2. The feedback switch SS2 performs a switching operation by the dimming off control signal DCON. Specifically, when the dimming off control signal DCON has the high level, the feedback switch SS1 is turned off. Then, since the second photo diode PD2 does not emit a beam, a current does not flow in the second photo transistor PT2. A voltage of one end of the capacitor C13 is the second feedback signal FB2 is controlled by a current flowing the second photo transistor PT2. When the current flowing in the second photo transistor PT2 increases, the capacitor C13 is discharged such that the second feedback signal FB2 decreases. When the current flowing in the second photo transistor PT2 decreases, the capacitor C13 is charged with a current supplied form the controller 500 such that the second feedback signal FB2 increases.

The first feedback signal generator 401 generates the first feedback signal FB1 according to a sink current transferred from the first feedback signal controller 310. The first feedback signal generator 401 includes a first photo transistor PT1 and a first photo diode PD1 forming a photo coupler, and a resistor R11.

The power voltage VCC1 is supplied to one end of the resistor R11, an anode electrode of the first photo diode PD1 is connected to the other end of the resistor R11, and a cathode electrode of the first photo diode PD1 is connected to the first feedback signal controller 310 such that the currents of the first and second sink current sources PS1 and PS2 flows in the first photo diode PD1.

Hereinafter, the operations of the controller 500, and the first and second feedback signal generators 401 and 402 will be described in detail with reference to FIG. 4.

FIG. 4 is a drawing illustrating a schematic configuration of the controller 500 according to an exemplary embodiment of the present invention.

As shown in FIG. 4, the controller 500 includes the power switch M, a PWM controller 503, a protection controller 505, and a gate driver 506. The power switch M is an N-channel-type MOSFET. However, the present invention is not limited thereto.

A drain electrode of the power switch M is connected to one end of the primary-side coil CO1 of the transformer 600. A source electrode of the power switch M is grounded, and a gate signal VG is transmitted from the gate driver 506 to a gate electrode. The power switch M is turned on by the gate signal VG at the high level, and is turned off by the gate signal VG at the low level. When the power switch M is turned on, a current flows in the primary-side coil CO1 such that energy is stored, and when the power switch M is turned off, the energy stored in the primary-side coil CO1 is transferred to the secondary-side coil CO2. Then, a current flows in the secondary-side coil CO2 and the output voltage VOUT is generated.

The gate driver 506 includes an SR latch 501 to which the protection signal PS is transmitted, and an NOR gate 502 to which an output signal of the SR latch 501, a second dimming off signal DOFF2, and a PWM control signal PWC are input. When a signal input to a set terminal S has a high level, the SR latch 501 outputs a high-level signal through an output terminal Q, when a signal input to a reset terminal R has a high level, the SR latch 501 outputs a low-level signal through the output terminal Q. When all of the input signals have the low level, the NOR gate 502 output a high-level signal.

The protection controller 505 generates a protection signal PS and the second dimming off signal DOFF2 for turning off the power switch M according to the first feedback signal FB1. The second dimming off signal DOFF2 is a signal for turning off the power switch M in order to preventing the output voltage from rising when the current supplied to the LED panel unit 100 rapidly decreases in a normal state (a dimming off period in which all of the LED channels do not emit light). The protection signal PS is a signal for turning off the power switch M in a defective state in which a LED of the LED channels is opened or short-circuited.

Even when the power switch M is turned off by the second dimming off signal DOFF2, if a high-level dimming signal for supplying a current to the LED channels is generated again, the power switch M is turned on. However, when the power switch M is turned off by the protection signal PS, the power switch M is maintained in the OFF state until it becomes the normal state by replacing the opened or short-circuited LED.

The protection controller 505 includes a plurality transistors M1, M2, and M3 constituting a current mirror circuit, a resistor R14 for generating the second dimming off signal DOFF2, and a resistor R13 for generating the protection signal PS.

When the dimming off control switch DCONS is turned on by the dimming off control signal DCON, a current flows in the transistor M1 by the current of the second sink current source IS4. At this time, it is assumed that the ratios of lengths/widths of the channels of the transistors M1, M2, and M3 are identical and the resistor R14 has a resistance value that is one hundred times that of the resistor R13. Then, a current having the same magnitude of the current flowing in the transistor M1 flows in the transistor M2 and the transistor M3. At this time, a voltage occurring in the resistor R14 is one hundred times a voltage occurring in the resistor R13. That is the second dimming off control signal DOFF2 is a voltage corresponding to one hundred times the voltage of the protection signal PS. Therefore, the second dimming off control signal DOFF2 is a high-level signal, and the protection signal PS is a signal having a relatively low level. The high-level second dimming off control signal DOFF2 is input to the NOR gate 502, and the NOR gate 502 generates the gate signal VG having a low level.

When the protection switch PRS is turned on by the protection control signal PRC, a current flows in the transistor M1 by the current of the first sink current source IS3. At this time, it is assumed that the current of the first sink current source IS3 is one hundred times the current of the second sink current source IS4. Then, the voltage of the protection signal PS is a voltage having the same magnitude as the second dimming off control signal DOFF2 generated by the dimming off control signal DCON, and has a high level.

When the protection signal PS has the high level, the SR latch 501 outputs a high-level signal, and the NOR gate 502 generates the gate signal VG at the low level.

The PWM controller 503 determines a duty of the power switch M according to the second feedback signal FB2 transmitted while the feedback switch SS2 is in an ON state. The feedback switch SS2 is turned off according to the second dimming off signal DOFF2 at the high level, and is turned on according to the second dimming off signal DOFF2 at the low level. During a period when the feedback switch SS2 is in the OFF state, that is, a dimming off period, the PWM controller 503 controls the duty of the power switch M according to the second feedback signal FB2 corresponding to a dimming off period start point. When any one of a plurality of dimming signals PWM1 to PWM4 becomes the high level in order for a current to flow in a corresponding LED channel, the second dimming off signal DOFF2 becomes the low level and thus the feedback switch SS2 is turned on. Specifically, when a triangular wave (not shown) increasing with a predetermined slope during a period when the power switch M is in the ON state reaches the second feedback signal FB2, the PWM controller 503 transmits a high-level signal to the NOR gate 502 to turn off the power switch M.

As described above, according to the related art, the output voltage is overshoot at a time point when the dimming off period starts. In an exemplary embodiment of the present invention, since the power switch M is turned off by the second dimming off signal DOFF2 at a time point when the dimming off period start such that energy is not stored in the primary-side coil CO1, energy transferred to the secondary-side coil CO2 decreases. Therefore, since a current is not supplied to the output terminal connected to the secondary-side coil CO2, it is possible to prevent the output voltage from being overshoot.

Further, since the switching operation of the power switch M is controlled according to the second feedback signal FB2 of a dimming off start point at a time point when the dimming off period ends, the output voltage VOUT is maintained constantly without being overshoot. When the dimming off period ends, the currents flowing in the plurality of LED channels rapidly increase. At this time, if the duty of the power switch M gradually increases in a soft-start manner, undershoot occurs. However, in an exemplary embodiment of the present invention, since the feedback switch SS2 is turned on at a dimming off time point and the duty of the power switch M is determined by reflecting the second feedback signal FB2 at the dimming off start time point, it is possible to prevent undershoot of the output voltage VOUT. Further, when an LED channel is opened or short-circuited, the power switch M is maintained in the OFF state by the protection signal PS input to the set terminal of the SR latch 501 and this state is maintained until a reset signal is input to the reset terminal of the SR latch 501. The reset signal may be defined as a signal generated when the LED light emitting device operates again.

Further, the secondary side on which the LED driver 300 is positioned and the primary side on which the controller 500 controlling power transfer is positioned are insulated, and the feedback information informing the LED panel state is transmitted from the LED driver 300 to the controller 500 by using the first and the second feedback signal generators. Therefore, the feedback information can be exactly transmitted to the primary side.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. An LED light emitting device including a plurality of LED channels including a plurality of LEDs, comprising:

a transformer configured to convert an input voltage and supply an output voltage to the plurality of LED channels;

a controller configured to control the transformer according to a first feedback signal for interrupting power supply to the plurality of LED channels when a dimming off state in which currents are not supplied to the plurality of LED channels occurs or when a state in which the maximum channel voltage of a plurality of channel voltages corresponding to voltages applied to the plurality of LED channels, respectively, is an overvoltage and a defective state in which the plurality of LED channels include an open state are maintained during a predetermined threshold period; and an LED driver configured to generate information on the dimming off state and information on the defective state, the LED driver comprising a first feedback signal generator that includes a first photo diode emitting beams corresponding to a first sink current and a second sink current, and a first photo transistor in which a current corresponding to an amount of beam emitted by the first photo diode flows, wherein the LED driver is connected to a secondary side of the transformer, the controller is connected to a primary side of the transformer insulated from the secondary side, and the first feedback signal is generated according to the information on the dimming off state and the information on the defective state.

2. The LED light emitting device of claim 1, wherein:

the LED driver further comprises a first feedback signal controller including a first sink current source for supplying the first sink current when the dimming off state occurs, and a second sink current source for supplying the second sink current when the defective state occurs.

3. The LED light emitting device of claim 2, wherein:

the LED driver further includes a defect sensor configured to receive a first current when at least one of the plurality of LED channels is in an open state, to receive a second current when the maximum channel voltage is an overvoltage, and to control the first feedback signal controller such that the second sink current flows in the first feedback signal generator when a voltage charged by the first current and the second current is equal to or greater than a defect voltage for determining the defective state.

4. The LED light emitting device of claim 3, wherein:

the defect sensor includes a capacitor:

a first switch connected between the capacitor and a first current source for supplying the first current;

a second switch connected between the capacitor and a second current source for supplying the second current; and a comparator configured to receive a voltage charged in the capacitor and the defect voltage and to compare them, wherein an output voltage of the comparator is transferred to the first feedback signal controller.

5. The LED light emitting device of claim 2, wherein:

the LED driver further includes a dimming-off determining unit configured to determine the dimming off state by using a plurality of dimming signals controlling current supply to the plurality of LED channels, and the dimming-off determining unit controls the first feedback signal controller such that the first sink current flows in the first feedback signal generator.

6. The LED light emitting device of claim 2, wherein:

the first feedback signal controller includes:

a first switch connecting the first sink current source and the first feedback signal generator; and a second switch connecting the second sink current source and the second feedback signal generator, and wherein the second sink current is larger than the first sink current.

7. The LED light emitting device of claim 2, wherein:

the controller includes:

a power switch connected to the primary side of the transformer; and a protection controller including a current mirror circuit for coping a current flowing in the first photo transistor and supplying currents to a first resistor and a second resistor, and the power switch is turned off according to a dimming off signal generated by supplying the current to the first resistor and a protection signal generated by supplying the current to the second resistor.

8. The LED light emitting device of claim 7, wherein:

the controller further includes:

an SR latch configured to receive the protection signal through a set terminal and generate and maintain a signal for turning off the power switch at a time point when the protection signal changes form a first level to a second level; and a gate driver configured to generate a gate signal for controlling the switching operation of the power switch according to an output signal of the SR latch and the dimming off signal.

9. The LED light emitting device of claim 7, wherein:

the controller further includes a PWM controller configured to control the operation of the power switch according to a second feedback signal based on the minimum channel voltage of the plurality of channel voltages and to maintain the second feedback signal corresponding to a start time point of the dimming off state during the dimming off state period.

10. The LED light emitting device of claim 9, further comprising:

a second feedback signal generator configured to generate a second feedback signal to correspond to a comparison voltage corresponding to the minimum channel voltage, and to constantly maintain the second feedback signal corresponding to the start time point of the dimming off state during the dimming off state.

11. The LED light emitting device of claim 10, wherein:

the LED driver further includes a second feedback signal controller configured to control the second feedback signal generator such that the minimum channel voltage is maintained at a predetermined minimum reference voltage.

12. The LED light emitting device of claim 7, wherein the first resistor has a resistance value smaller than the second resistor.

13. The LED light emitting device of claim 1, wherein:

the controller controls the operation of the transformer according to a second feedback signal based on a minimum channel voltage of the plurality of channel voltages, and maintains the second feedback signal corresponding to a start time point of the dimming off state.

14. The LED light emitting device of claim 13, further comprising:

a second feedback signal generator configured to generate the second feedback signal to correspond to a comparison voltage corresponding to the minimum voltage, and to constantly maintain the second feedback signal corresponding to the start time point of the dimming off state.

15. The LED light emitting device of claim 14, wherein:

the LED driver further includes a second feedback signal controller configured to control the second feedback signal generator such that the minimum channel voltage is maintained at a minimum reference voltage.

16. The LED light emitting device of claim 15, wherein:

the second feedback signal controller includes:

a shunt regulator including a first terminal to receive the minimum channel voltage, a second terminal grounded, and a third terminal connected to the second feedback signal generator, and configured to interrupt the second terminal and the third terminal when the minimum channel voltage is smaller than the minimum reference voltage and to connect the second terminal and the third terminal when the minimum channel voltage is equal to or greater than the minimum reference voltage; and a capacitor connected between the third terminal and the first terminal, the comparison voltage is a voltage of the third terminal.

17. The LED light emitting device of claim 16, wherein:

the second feedback signal generator includes:

a second photo diode having a cathode electrode connected to the third terminal and an anode to which a predetermined current is supplied;

a second feedback signal generator including a second photo transistor in which a current corresponding to an amount of beam emitted by the second photo diode flows; and a switch configured to be turned off during the dimming off period so as to interrupt current supply to the second photo diode.

18. An LED light emitting device including a plurality of LED channels including a plurality of LEDs, comprising:

a transformer configured to convert an input voltage and supply an output voltage to the plurality of LED channels;

a controller configured to control the transformer according to a first feedback signal for interrupting power supply to the plurality of LED channels when a dimming off state in which currents are not supplied to the plurality of LED channels occurs or when a state in which the maximum channel voltage of a plurality of channel voltages corresponding to voltages applied to the plurality of LED channels, respectively, is an overvoltage and a defective state in which the plurality of LED channels include an open state are maintained during a predetermined threshold period; and an LED driver configured to generate information on the dimming off state and information on the defective state, wherein the LED driver is connected to a secondary side of the transformer, the controller is connected to a primary side of the transformer insulated from the secondary side, the first feedback signal is generated according to the information on the dimming off state and the information on the defective state, and the controller controls the operation of the transformer according to a second feedback signal based on a minimum channel voltage of the plurality of channel voltages and maintains the second feedback signal corresponding to a start time point of the dimming off state.

19. The LED light emitting device of claim 18, further comprising:

a second feedback signal generator configured to generate the second feedback signal to correspond to a comparison voltage corresponding to the minimum voltage, and to constantly maintain the second feedback signal corresponding to the start time point of the dimming off state.

20. The LED light emitting device of claim 19, wherein:

the LED driver further includes a second feedback signal controller configured to control the second feedback signal generator such that the minimum channel voltage is maintained at a minimum reference voltage.

21. The LED light emitting device of claim 20, wherein:

the second feedback signal controller includes:

a shunt regulator including a first terminal to receive the minimum channel voltage, a second terminal grounded, and a third terminal connected to the second feedback signal generator, and configured to interrupt the second terminal and the third terminal when the minimum channel voltage is smaller than the minimum reference voltage and to connect the second terminal and the third terminal when the minimum channel voltage is equal to or greater than the minimum reference voltage; and a capacitor connected between the third terminal and the first terminal, the comparison voltage is a voltage of the third terminal.

22. The LED light emitting device of claim 21, wherein:

the second feedback signal generator includes:

a second photo diode having a cathode electrode connected to the third terminal and an anode to which a predetermined current is supplied;

a second feedback signal generator including a second photo transistor in which a current corresponding to an amount of beam emitted by the second photo diode flows; and a switch configured to be turned off during the dimming off period so as to interrupt current supply to the second photo diode.

* * * * *